US006453926B1

(12) United States Patent
Baker

(10) Patent No.: US 6,453,926 B1
(45) Date of Patent: Sep. 24, 2002

(54) METHOD AND APPARATUS FOR INJECTING A CHEMICAL INTO A FLUID STREAM

(76) Inventor: Gary A. Baker, 1891 Sardine Creek Rd., Gold Hill, OR (US) 97525

( * ) Notice: Subject to any disclaimer, the term of this patent is extended or adjusted under 35 U.S.C. 154(b) by 0 days.

(21) Appl. No.: 09/832,432

(22) Filed: Apr. 10, 2001

(51) Int. Cl.[7] ..... F04F 5/00
(52) U.S. Cl. ..... 137/3; 137/888; 366/167.1
(58) Field of Search ..... 137/888, 896, 137/897, 605, 3, 7; 366/167.1

(56) References Cited

U.S. PATENT DOCUMENTS 4,474,477 A * 10/1984 Smith et al. ..... 366/165
4,647,212 A * 3/1987 Hankison ..... 137/896 X
5,775,592 A * 7/1998 Goldsmith et al. ..... 137/892 X

* cited by examiner

*Primary Examiner*—Kevin Lee
(74) *Attorney, Agent, or Firm*—Marger Johnson & McCollom, P.C.

(57) ABSTRACT

An apparatus for introducing a chemical into a fluid stream comprises a chemical injector adapted to be interposed within the path of the fluid stream flowing from an upstream conduit to a downstream conduit. The chemical injector includes primary and secondary channels, substantially parallel to the fluid flow through the upstream conduit, and a chemical feed channel having an input end, adapted to communicate with a chemical source, and an output end coupled at an angle to the secondary channel. Injection of a chemical into a fluid stream comprises directing the stream through an upstream conduit; dividing the stream into a primary flow and a substantially parallel secondary flow; coupling a chemical source at an angle to the secondary flow; increasing the fluid flow pressure until chemical flow into the secondary flow is induced by vacuum pressure; and directing the primary and secondary flows into the downstream conduit.

18 Claims, 6 Drawing Sheets

METHOD AND APPARATUS FOR INJECTING A CHEMICAL INTO A FLUID STREAM

BACKGROUND OF THE INVENTION

The present invention is related to a chemical injector, and more specifically to a system for inducing chemical treatment of a fluid stream, such as dechlorination of water, and introduction of the chemical into a fluid stream without diverting the direction of flow of the fluid stream itself.

Dechlorination of water from the pipes of a residential development is presented as an illustrative application of the present device and method. In such development sites, newly-installed pipes are treated with chlorinated water. The chlorinated water must be removed from the pipes before normal water may be flowed therethrough for conventional residential use.

Typically, environmental regulations prohibit pumping out chlorinated water onto the ground, where it would be absorbed into the soil. Similarly, it is undesirable for chlorinated water to be pumped out into the street for removal via storm drains, as such drained water and chlorine would then contaminate lakes, ponds, streams and other water run-off sites. Accordingly, the need remains for a method for efficiently neutralizing chlorine in the water.

Common chlorine-neutralizing substances include ascorbic acid and sodium bisulfate, ($NaHSO_4$). Sodium bisulfate is a relatively expensive neutralizing compound and its use in chlorinated water treatment is preferably optimized to consume no more sodium bisulfate than is necessary for the neutralization. Additionally, byproducts of the chlorine-neutralizing substances may themselves be subject to environmental regulations. For this reason, it is desirable that waste water contain as low a concentration of the chlorine-neutralizing substance as possible.

In other applications wherein a selected amount of chemical is to be introduced into a particular volume of fluid, a system may be employed which introduces chemical at a steady rate, irrespective of fluctuations in fluid stream flow rate. This chemical introduction scheme is effective because importance is placed on the final concentration of chemical in the fluid. Where aliquots are to be taken from the stream during chemical introduction, it becomes critical that the chemical concentration remain constant at any point in the fluid stream. An example of such applications include, e.g., liquid-state pharmaceutical manufacturing wherein chemical is injected into a fluid stream and the mixture portioned flow-wise into containers for market. Similarly, in agricultural pesticide injection into irrigation fluid flowed to a crop site for application thereto, it is desirable that a particular concentration of pesticide be applied per volume of irrigation water. As well, constant chemical introduction rate systems are inadequate when it is desired that the chemical injection rate be dynamically adjustable (e.g., dechlorination of water, wherein chlorination decreases during the dechlorination process and the rate of neutralizing chemical injection must be correspondingly reduced).

The present invention is intended to overcome these problems and limitations of the prior art.

SUMMARY OF THE INVENTION

Generally, the present invention provides an apparatus for introducing a chemical into a fluid stream, comprising a chemical injector adapted to be interposed within the path of the fluid stream flowing from an upstream conduit to a downstream conduit. The chemical injector includes a primary channel and one or more secondary channels running the length of the conduit in substantially parallel relation to the path of fluid flow through the upstream conduit. The injector further includes a first chemical feed channel, having an input end adapted to be in communication with a source of the chemical to be introduced into the fluid stream, and an output end, coupled at an oblique angle to the first secondary channel of the chemical injector.

Another aspect of the present invention is a method for introducing a chemical into a fluid stream, comprising directing a fluid stream through an upstream conduit. The fluid stream is divided into a primary flow and a substantially parallel secondary flow. A chemical source is coupled at an oblique angle to the secondary flow, and fluid flow pressure is increased until flow from the chemical source into the secondary flow is induced by vacuum pressure. The primary flow and the secondary flow are then directed into the downstream conduit.

BRIEF DESCRIPTION OF THE DRAWINGS

The invention will become more readily apparent from the following Detailed Description, which proceeds with reference to the drawings, in which.

DETAILED DESCRIPTION

The present invention provides a way to introduce a chemical into a fluid stream, injecting and intermixing said chemical with the fluid stream. As used herein, the term "fluid" is meant to refer to a substance that is flowed or capable of flowing, without limitation as to the state of the substance being so flowed. In other words, where a stream of oxygen can be passed through the apparatus, the oxygen flow would be referred to herein as a fluid stream of oxygen.

Figure 1:
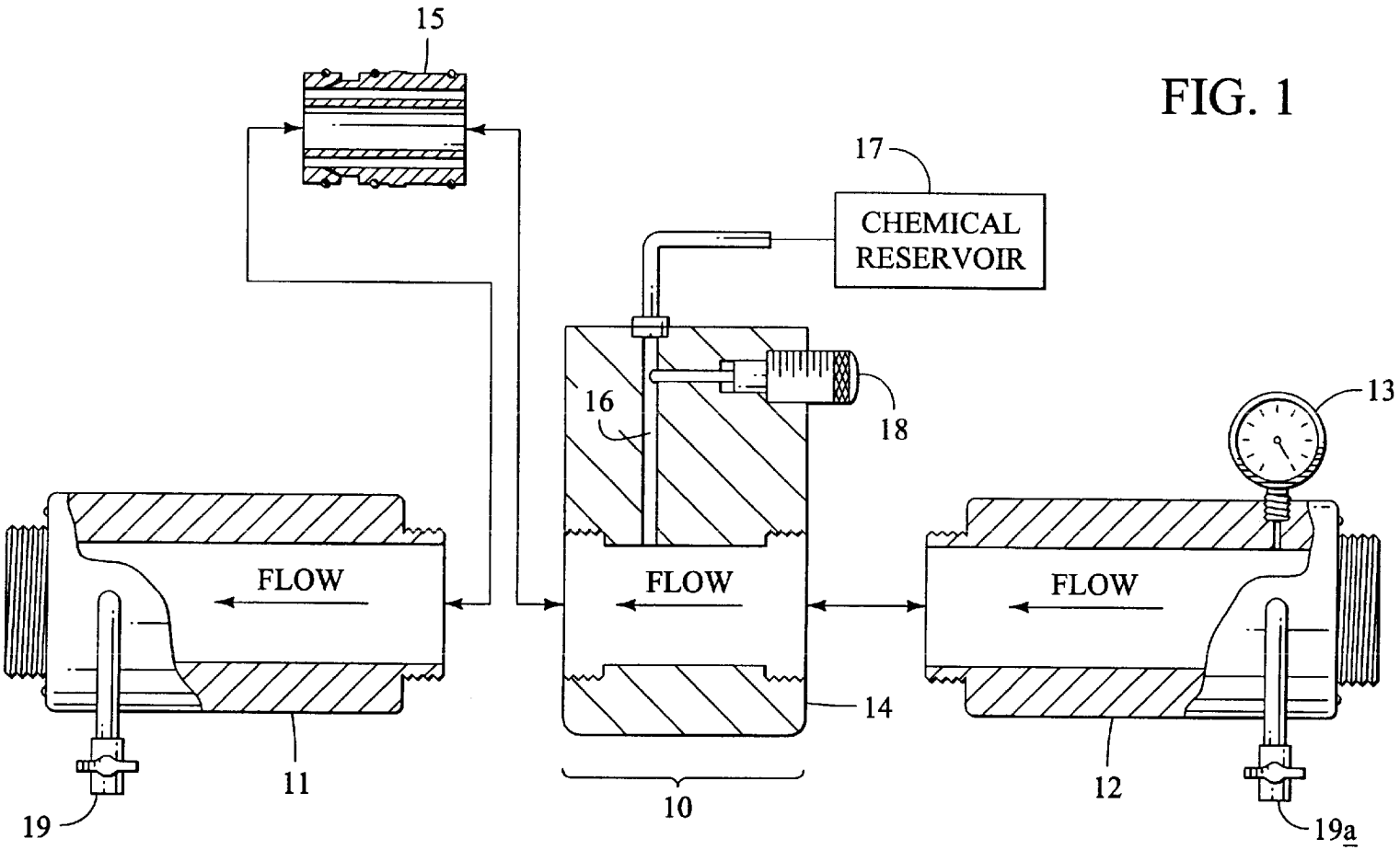
FIG. 1 is an exploded sectional side view of a chemical injection system constructed according to a preferred embodiment of the invention.

One embodiment of the apparatus according to the present invention is shown in FIG. 1. This embodiment of the apparatus comprises a chemical injector system 10 adapted to be interposed within a fluid stream, communicated through downstream conduit 11 and upstream conduit 12. A pressure gauge 13 can be provided in the downstream conduit 11 to monitor fluid flow rate through said conduit and into the chemical injector system 10.

In the embodiment herein described, the chemical injector system 10 comprises an injector housing 14, an appropriately sized cavity into which can be inserted a mixing insert 15. The housing 14 further comprises a chemical feed port 16 coupled to a source of chemical 17, and preferably also comprises a chemical flow regulation valve 18. The cavity is preferably sized of substantially identical cross-section to the cross-section of the conduits.

A flow gauge 13 may optionally be placed in the upstream conduit 12 to read the flow rate of the fluid stream approaching the chemical injector system 10. Additionally, sample taps 19*a*, 19 may be placed in the downstream and/or upstream conduits 11, 12. Samples can be drawn therefrom to measure the extent of fluid stream chlorination upstream and dechlorination downstream of the chemical injector system 10. The chemical flow regulation valve 18 may then be operated to adjust the level of treating chemical drawn into the fluid stream as described in more detail below.

Figure 2:
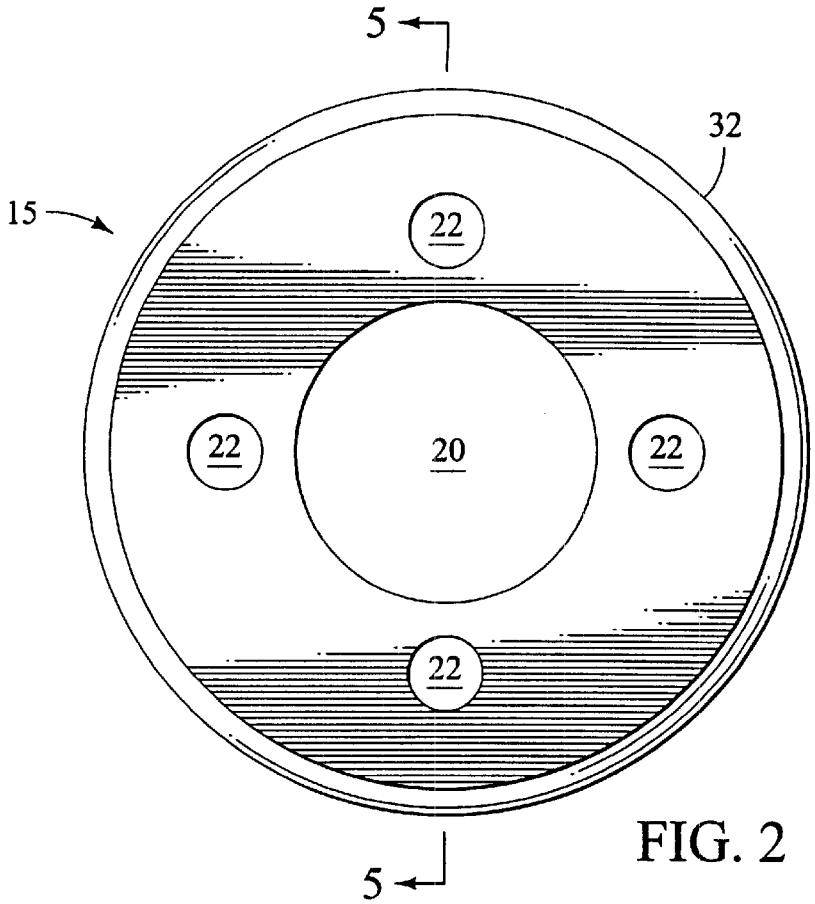
FIG. 2 is a front face view of the insert in the embodiment of FIG. 1.
Figure 3:
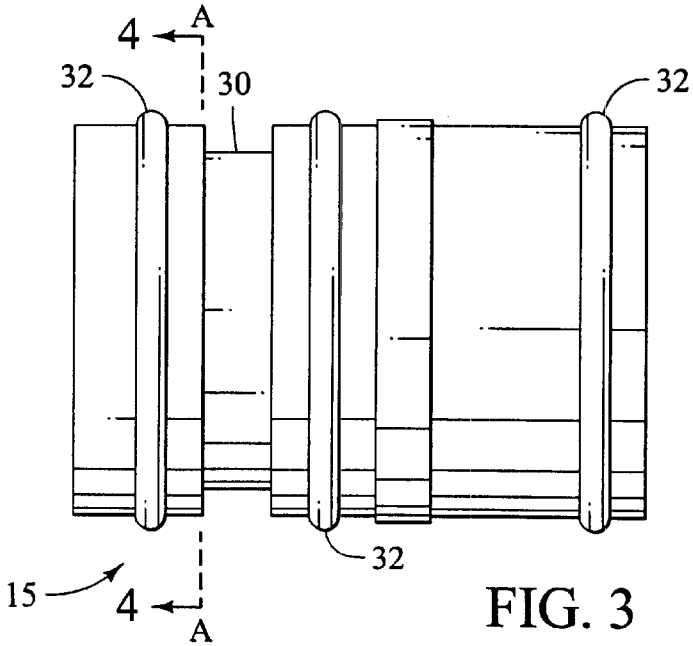
FIG. 3 is a side view of the insert in the embodiment of FIG. 1.

The mixing insert 15 of this embodiment is further described in FIGS. 2 and 3, which illustrate respective front face and side views of the insert. The mixing insert 15 includes a primary channel 20 and one or more secondary channels 22 running the length of the mixing insert 15 in substantially parallel relation, and in the preferred embodiment in axially-aligned relationship, to the path of fluid flow through the downstream and upstream conduits 11, 12. A chemical staging chamber according to this embodiment is shown as an annular groove 30 extending around the circumference of the mixing insert 15. Other embodiments can be contemplated. For example, the staging chamber could be an annular groove extending only partway around the insert circumference, the staging chamber may be shaped as a groove or indentation coursing longitudinally along the insert surface, or the staging chamber simply may be a depression in the mixing insert communicating directly with the chemical feed port 16 according to this embodiment.

Fluid sealing means are also provided (the fluid sealing means depicted in this embodiment as O-rings 32). The fluid sealing means contact the interior wall of the injector housing 14 to prevent chemical within the staging chamber 30 from escaping into the space between the interior wall and the mixing insert 15.

Figure 4:
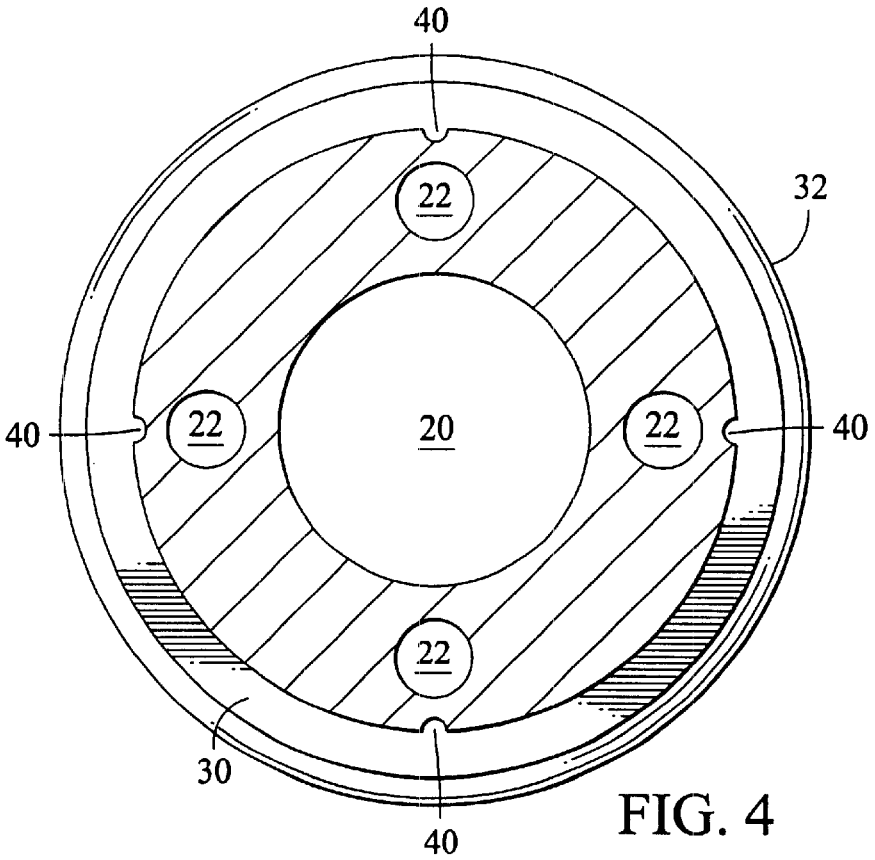
FIG. 4 is a front face view of the insert, sectioned along line 4—4 in FIG. 3.
Figure 5:
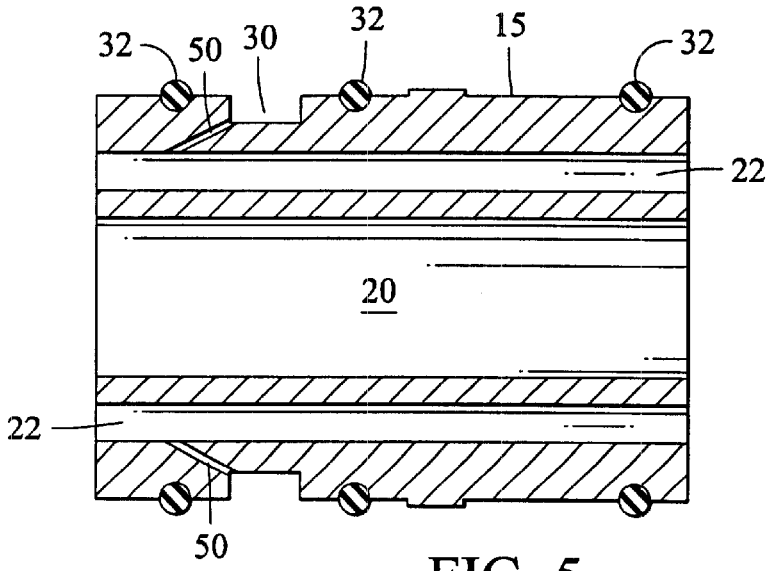
FIG. 5 is a side section view of the insert, with the section occurring along line 5—5 in FIG. 2.

FIG. 4 shows a sectioned face view of the mixing insert 15 according to this embodiment, with the section occurring at the upstream side of the chemical staging chamber 30. The section plane of FIG. 5 occurs along the longitudinal axis of the mixing insert. The mixing insert is provided with at least one chemical feed channel 50, communicating at its input end (visible in FIG. 4 as opening 40) with the chemical staging chamber 30 and at its output end with a secondary channel 22.

Figure 6:
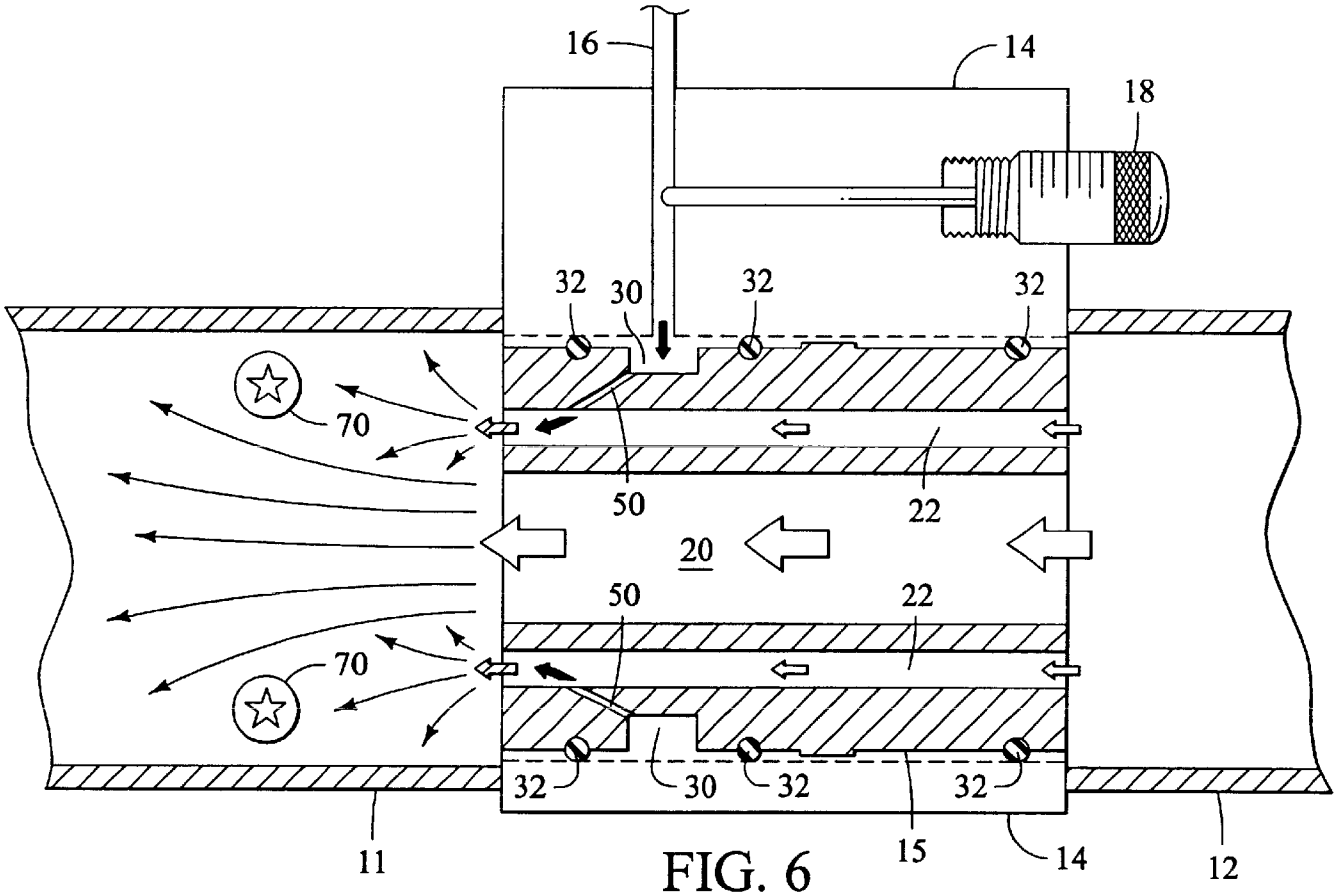
FIG. 6 is a side section view of the assembled system of FIG. 1 showing fluid flow and turbulence.

Turning now to FIG. 6, the apparatus is adapted to be coupled to the pipe system such that fluid within the pipe system is flowed through the apparatus. Fluid flowing therethrough passes through the upstream conduit 12, the chemical injector system 10 and the downstream conduit 11. Specifically, fluid passes through the chemical injector system 10 by passing through the primary channel 20 in the mixing insert 15, although fluid also flows through one or more secondary channels 22. Fluid emerging from the primary channel 20 exerts a back-pressure (stars 70) on the secondary channel 22 at its opening on the downstream face of the mixing insert 15.

Continuing the example of water dechlorination, the apparatus for injecting a chemical into a fluid stream operates with chlorinated water traveling therethrough at a broad range of flow rates. The neutralizing chemical, e.g., sodium bisulfate, resides in the chemical reservoir 17 (FIG. 1). Either by gravity or the back-pressure exerted upon the secondary channel 22 at its opening on the downstream face of the mixing insert 15, chemical (black arrows) is drawn from the chemical reservoir 17 through the chemical feed port 16 and into the chemical staging chamber 30 of the mixing insert 15.

Figure 7:
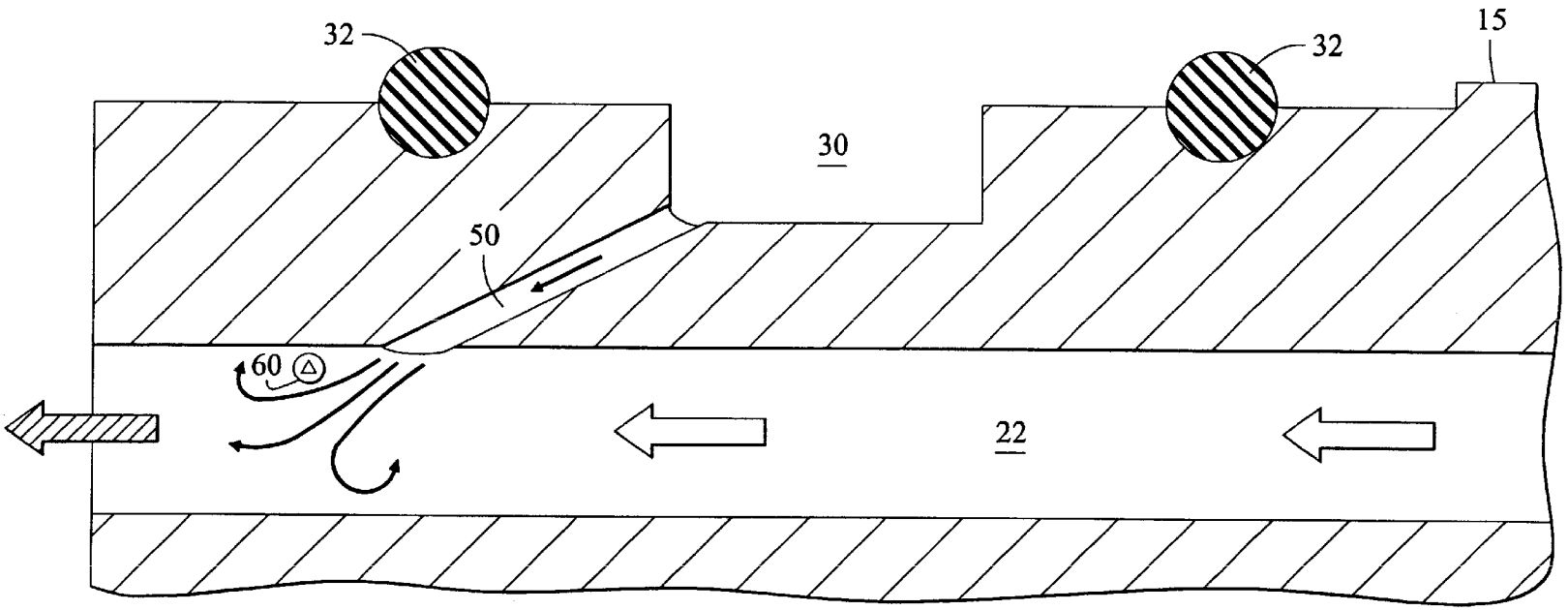
FIG. 7 is a magnified section view of the interface between the secondary flow channel and the chemical feed channel of the assembly of FIG. 6.

FIG. 7 illustrates the back-pressure 60 adjacent the interface of the chemical feed channel 50 with the secondary channel 22, created by fluid flow through the apparatus. Back-pressure 60 draws chemical through chemical feed channel 50 and into the secondary channel 22. Oblique entry of the chemical feed channel 50 into a secondary channel 22 best aids in creating a sufficient back-pressure 60 to introduce chemical from the chemical staging chamber 30 through the chemical feed channel 50 and into the fluid stream flowing through a secondary channel 22.

A properly functioning embodiment of the present invention can have a chemical feed channel 50 perpendicular to the direction of fluid flow. However, the more acute the angle between the chemical feed channel 50 and the direction of incoming fluid flow through the mixing insert 15, the more readily vacuum pressure 60 is exerted on the chemical in the chemical feed channel. The acuteness of the angle may be in some embodiments limited by the dimensions of the mixing insert 15. In the preferred embodiment described herein, the chemical feed channels 50 are angled at approximately 30° relative to the fluid flow path through the apparatus.

Chemical drawn into the secondary channel 22 is carried with fluid flowing therethrough and exits the downstream face of the mixing insert 15. As the fluid-chemical mixture exits the secondary channel 22, it mixes turbidly (FIG. 6, 70) with fluid exiting the mixing insert 15 via the primary channel 20.

The apparatus and method of the present invention can be used to introduce a chemical into a fluid stream. As discussed in the example of water dechlorination the fluid stream and chemical are both in an freely flowing liquid state. Alternatively, either the fluid stream or the chemical can be viscous, exemplary of pharmaceutical applications. In yet other embodiments, a gaseous stream can be passed through the apparatus and chemical injected into such stream. Similarly, the chemical also can be in a gaseous state. Introduction of gaseous chemical, including air, can be performed to aerate liquid, for example in a water body in which aquatic flora or fauna are to be sustained.

A preferred embodiment of the method for introducing a chemical into a fluid stream comprises directing a fluid stream having a flow pressure through an upstream conduit; dividing the fluid stream into a primary flow and a substantially parallel secondary flow; coupling a chemical source at an oblique angle to the secondary flow; increasing the flow pressure until chemical flow from the chemical source into the secondary flow is induced by vacuum pressure; and directing the primary flow and the secondary flow into the downstream conduit.

The preferred embodiment of the present apparatus as described above was constructed for employment in an exemplary water dechlorination process. The mixing insert 15 had a length 8.05 cm. The chemical staging chamber was constructed in this embodiment as an annular groove 30, extending around the circumference (16.56 cm) of the mixing insert 15. The annular groove had a volume of approximately 23.4 $cm^3$ (width 1.08 cm, depth 0.35 cm). Chemical feed channels 50, coupling the chemical feed port 16 of the injector housing 14 with the secondary channel 22 were of diameter 0.23 cm. The upstream and downstream conduits were one inch (2.54 cm) diameter pipe. The primary channel 20 and four secondary channels 22 of the mixing insert 15 were of diameter 2.54 cm and 0.65 cm, respectively., The chemical reservoir 17 was positioned below the conduits, such that chemical flow into the apparatus was not the result of gravity feeding or siphoning.

The present method was implemented in a residential development, using the above-described embodiment of the present system additionally having upstream and downstream conduits adapted to be coupled to the water piping of the residential development. Approximately 6600 liters (8000 feet of 8-inch-diameter pipe) chlorinated at 100 ppm were treated with $NaHSO_4$. The water was flowed through the system at a flow rate of 220–250 gpm (approximately 825–950 liters per minute). About 23 liters of sodium bisulfate were drawn into the system and mixed with the chlorinated water over a period of about thirty minutes. Complete neutralization of the chlorine was observed at an output sample tap 19 nine inches downstream of the chemical injector system 10.

It should be noted that, in the example use discussed herein, non-chlorinated water replaces the chlorinated water in the pipe system during a dechlorination procedure. In other words, the injection rate of chemical into the fluid stream is not static; rather the chemical flow must be regulated to deliver substantially as much neutralizing agent as is needed for the chlorination level of the water being contemporaneously flowed through the apparatus. For this reason, the chlorination level of the water flowing through the apparatus decreases with time, requiring an equivalent decrease in the amount of chemical needed to neutralize the water.

Figure 8A:
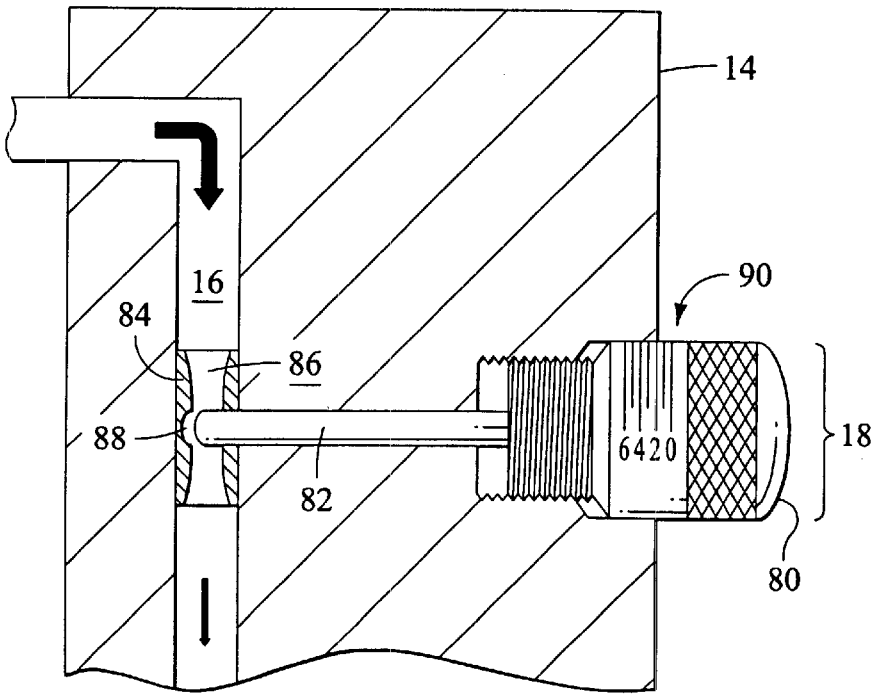
FIGS. 8A and 8B are magnified cross-section views of the chemical injector system of FIG. 1, showing the chemical flow regulation valve in a partially open position and in a fully open position, respectively.
Figure 8B:
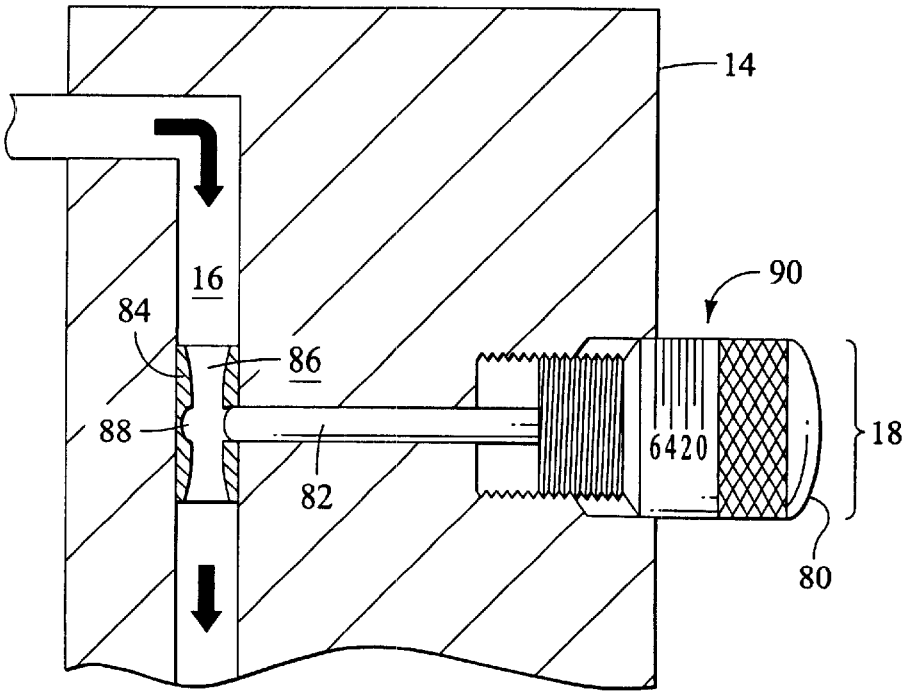

A chemical flow regulation valve 18, shown in greater detail in FIG. 8, can be provided to meter the rate of chemical introduction, thereby achieving efficient dechlorination. Regulation of maximum chemical flow through the chemical feed port 16 permits consumption of only so much chemical as is desired. In alternate embodiments, in which a sample tap (upstream or downstream) and chemical flow regulation valve are monitored automated or by a user, the valve 18 can be manipulated to correlate chemical flow to the degree necessary for fluid treatment and the rate of fluid flow through the apparatus. Monitoring of the dechlorination process at the tap 19 can occur in real-time and adjustment of valve 18 made to the effect the desired treatment parameters.

The valve assembly 18 shown in FIG. 8 is of a standard type with graduated markings. The markings are useful in controlling the number of full and partial revolutions that the valve adjustment knob is turned, corresponding with the degree to which the stem of the valve occludes the chemical feed port 16. For example, the valve setting "3" in the Table shown below indicates that the valve knob was turned three full revolutions from the closed position. In the embodiment used to generate the data shown below, the valve had a maximum open setting of six turns. However, other valves may be employed in other embodiments, having different graduations and flow rates.

| Fluid Stream flow rate, gpm | Valve setting | Chemical Flow rate, gph |
|---|---|---|
| 100 | 6 | 31 |
| 150 | 3 | 24 |
| 150 | 6 | 103 |
| 220 | 3 | 24 |

-continued

| Fluid Stream flow rate, gpm | Valve setting | Chemical Flow rate, gph |
|---|---|---|
| 220 | 4 | 60 |
| 220 | 5 | 80 |
| 220 | 6 | 103 |

The chemical flow regulation valve 18 can be used to set a maximum chemical flow rate through chemical feed port 16. The above Table shows this effect on a fluid stream entering the apparatus at 220 gallons per minute (gpm). Opening the regulation valve 18 three turns permitted chemical to be drawn into the chemical injector system at 24 gallons per hour (gph). When the valve setting was increased to 4 turns, chemical consumption rose to 60 gph; at 5 turns, chemical was used at 80 gph; and at 6 turns (valve fully open), chemical was drawn into the system at 103 gph.

The effect of the flow rate of the fluid stream on chemical injection is also apparent. In the analysis performed using a device constructed according to the preferred embodiment shown in FIG. 1 and described herein, the regulation valve 18 was opened fully, i.e., six turns, and chemical consumption from the chemical reservoir 17 was observed as a function of time. A fluid stream was flowed through the apparatus, with the fluid stream flow rate in the upstream conduit measured at 100, 150 and 220 gpm. The consumption of chemical was seen to vary, depending on fluid stream flow rate. Specifically, using the embodiment previously described, a valve setting of six turns open resulted in chemical draw rates of 31 gallons per hour (gph) at a fluid stream flow rate of 100 gallons per minute (gpm); and 103 gph at fluid stream flow rates of 150 gph and 220 gph. It is concluded that the maximum chemical flow rate of this embodiment is 103 gph.

It should be apparent that, where the maximum chemical flow rate is limited by the size of the channels through which chemical must travel, such maximum can be manipulated by construction of an embodiment with a differently sized chemical feed port 16 or chemical feed channel 50. It is anticipated that modification of the chemical feed channel 50 has the greatest effect on chemical flow rate through the apparatus described herein. The number of secondary channels 22 provided can also be increased or decreased—with concomitant increase or decrease in the number of chemical feed channels 50—to raise or lower, respectively, the amount of chemical drawn into the system by a fluid stream traveling at a given flow rate.

As well, a plurality of chemical staging chambers can be provided. Such an embodiment is useful for applications in which two or more chemicals are to be injected into the fluid stream without prior mixture of the chemicals, or to increase the number of chemical feed channels 50 while holding constant the number of secondary channels 22. Equivalent modifications also can be made to the diameter or shape of the primary channel 20 or the secondary channel 22.

A primary advantage of the present invention is the ability to admix chemical treatment within a fluidic stream without diverting the stream out of the normal forward path of the stream.

A person skilled in the art will be able to practice the present invention in view of the description present in this document, which is to be taken as a whole. Numerous details have been set forth in order to provide a more thorough understanding of the invention. In other instances, wellknown features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention can be modified in numerous ways. The inventor regards the subject matter of the invention to include all combinations and subcombinations of the various elements, features, functions and/or properties disclosed herein.

The invention claimed is:

1. An apparatus for introducing a chemical into a fluid stream, the apparatus comprising:

a chemical injector adapted to be interposed within an intended path of the fluid stream from an upstream conduit to a downstream conduit, said chemical injector including a primary channel and a first secondary channel running the length of the conduit in substantially parallel relation to an intended flow path of the stream through the upstream conduit; and a first chemical feed channel having an input end adapted to be in communication with a source of the chemical to be introduced into the stream, and an output end coupled at an oblique angle to the first secondary channel of the chemical injector.

2. The apparatus of claim 1, wherein the primary channel has a larger cross-sectional dimension than the first secondary channel.

3. The apparatus of claim 1, further comprising a chemical flow regulation valve coupled between the source of chemical and the output end of the first chemical feed channel.

4. The apparatus of claim 1, wherein the chemical injector includes a housing and a mixing insert nested within the housing, said housing including:

an inlet adapted to be coupled to the upstream conduit;

an outlet adapted to be coupled to the downstream conduit; and an interior wall defining a cavity between the inlet and the outlet, said wall including an opening in communication with the source of chemical.

5. The apparatus of claim 4, wherein the mixing insert includes a chemical staging chamber on an outer wall of the mixing insert, said chamber positioned adjacent the opening in the interior wall of the cavity of the housing and in communication with the first chemical feed channel.

6. The apparatus of claim 5, wherein the mixing insert further includes:

a second secondary channel spaced from the first secondary channel and running substantially parallel thereto; and a second chemical feed channel having an input end coupled to the chemical staging chamber and an output end coupled at an oblique angle to the second secondary channel.

7. The apparatus of claim 6, wherein a primary channel is positioned along an axis of the mixing insert, with the secondary channels arrayed substantially evenly about the periphery of the primary channel.

8. The apparatus of claim 1, further comprising a sample tap coupled to the downstream conduit and communicating with an interior cavity of said conduit.

9. A system for introducing a chemical into a fluid stream, the system comprising:

a conduit for flowing a stream therethrough, the conduit comprising an upstream conduit and a downstream conduit;

a chemical injector adapted to be interposed within the path of the fluid stream through the conduit, said chemical injector including a primary channel and a first secondary channel running the length of the conduit in substantially parallel elation to an intended path of stream flow through the conduit; and a first chemical feed channel having an input end adapted to be in communication with a source of the chemical to be introduced into the fluid stream, and an output end coupled at an oblique angle to the first secondary channel of the chemical injector.

10. The system of claim 9, wherein the primary channel has a larger cross-sectional dimension than the first secondary channel.

11. The system of claim 9, further comprising a chemical flow regulation valve coupled between the source of chemical and the output end of the first chemical feed channel.

12. The system of claim 9, wherein the chemical injector includes a housing and a mixing insert nested within the housing, said housing including:

an inlet adapted to be coupled to the upstream conduit;

an outlet adapted to be coupled to the downstream conduit; and an interior wall defining a cavity between the inlet and the outlet, said wall including an opening in communication with the source of chemical.

13. The system of claim 12, wherein the mixing insert includes a chemical staging chamber on an outer wall of the mixing insert, said chamber positioned adjacent the opening in the interior wall of the cavity of the housing and in communication with the first chemical feed channel.

14. The system of claim 13, wherein the mixing insert further includes:

a second secondary channel spaced from the first secondary channel and running substantially parallel thereto; and a second chemical feed channel having an input end coupled to the chemical staging chamber and an output end coupled at an oblique angle to the second secondary channel.

15. The system of claim 14, wherein a primary channel is positioned along an axis of the mixing insert, with the secondary channels arrayed substantially evenly about the periphery of the primary channel.

16. The system of claim 9, further comprising a sample tap coupled to the downstream conduit and communicating with an interior cavity of said conduit.

17. A method for introducing a chemical into a fluid stream, the method comprising:

directing a fluid stream having a flow pressure through an upstream conduit;

dividing the fluid stream into a primary flow and a substantially parallel secondary flow;

coupling a chemical source at an oblique angle to the secondary flow;

increasing the flow pressure until chemical flow from the chemical source into the secondary flow is induced by vacuum pressure; and directing the primary flow and the secondary flow into the downstream conduit.

18. The method of claim 17, further comprising merging the primary and secondary flows in the downstream conduit.

* * * * *